United States Patent [19]

Thornton

[11] 4,119,232

[45] Oct. 10, 1978

[54] DUAL LATCHING, CHILD-RESISTANT CONTAINER

[76] Inventor: Theodore Wayne Thornton, 2036 Laird Dr., Salt Lake City, Utah 84108

[21] Appl. No.: 860,178

[22] Filed: Dec. 13, 1977

[51] Int. Cl.[2] ..... B65D 55/02; B65D 85/56

[52] U.S. Cl. ..... 215/222; 220/298

[58] Field of Search ..... 215/211, 222, 223; 220/293, 298

[56] References Cited

U.S. PATENT DOCUMENTS

| | | | |
|---|---|---|---|
| 3,339,770 | 9/1967 | Weigand | 215/222 X |
| 4,053,078 | 10/1977 | Herr | 215/222 |
| 4,059,198 | 11/1977 | Mumford | 215/222 |

*Primary Examiner*—George T. Hall

*Attorney, Agent, or Firm*—Mallinckrodt & Mallinckrodt

[57] ABSTRACT

The version of the container of my U.S. Pat. No. 3,991,895, which provides a dual latching arrangement so that, by a first turning of the cover during the latching operation, a condition of easy opening for adults is obtained, and, if desired, a hard-to-open, child-resistant condition is obtained with a further turning of the cover, is improved by the provision of a positive stop at the end of the first turning of the cover to prevent inadvertent latching into child-resistant position and to require a positive, downward displacement of the cover before it can be turned into child-resistant condition.

3 Claims, 5 Drawing Figures

DUAL LATCHING, CHILD-RESISTANT CONTAINER

BACKGROUND OF THE INVENTION

1. Field

The invention is in the field of child-resistant containers, particularly medicine vials, which satisfy government safety requirements against opening by children.

2. State of the Art

Many different types of containers resistant to opening by children have been developed. Although furnishing protection for children, these have been annoying and sometimes dangerous when used to package prescriptions and other medicines required by adults, especially elderly people who often find them exceedingly difficult or impossible to open. Medicines that must be taken quickly to relieve various physical ailments, such as a heart condition, must be readily available. Thus, containers for medicines, e.g. pharmaceutical vials, of child resistant construction as a safety precaution against inadvertent opening by children can be dangerous for adults.

My U.S. Pat. No. 3,991,895 discloses a container that, in one form, provides for dual latching of the cover part to the receptacle part. A first turn of the cover attaches it to the receptacle in easy-to-open condition, while continued turning against yieldable resistance latches it to the receptacle in hard-to-open, child-resistant condition. Although a moisture-proof medicine vial is specifically shown and described, the dual latching feature is applicable to containers in general, with or without the moisture-proof feature.

A difficulty in using the dual latching container of my patent is that the yieldable resistance does not preclude continual turning of the cover into child-resistant condition and is often overcome at the end of the first turning of the cover, so that the child-resistant condition is reached inadvertently by adults intending to maintain the container in easy-to-open condition.

OBJECTIVE

The primary objective in the making of the present invention was to eliminate this difficulty and to provide a dual latching container that cannot be inadvertently latched into hard-to-open, child-resistant condition.

SUMMARY OF THE INVENTION

In accordance with the invention, the respective locking projections of the cover and receptacle parts of the container as originally disclosed and patented are modified to provide a positive stop to the turning action when the cover is in its first, easy-to-open latched condition, necessitating a positive, downward displacement of the cover before turning can be continued to latch it into the second, hard-to-open, child-resistant condition.

Thus, whereas the keeper lug and hook formations of the locking projections of the cover and receptacle parts, respectively, of the patented container are formed to provide for initial latching of each keeper lug in an advance retention bed of the corresponding hook formation, which bed leads smoothly but with some resistance into the hook portion of such hook formation, the keeper lug and hook formations of the locking projections of the cover and receptacle parts, respectively, of the improved container of the present invention are formed somewhat differently to specifically accomplish the purpose of the invention. The easily disengaged, advance bed of each hook formation of the receptacle part as now constructed terminates abruptly in a positive stop member that requires positive downward displacement of the cover before turning can be continued. Cooperating with such positive stop member is a corresponding stop member at the top of the keeper lug. As so constructed, latching of the cover into child-resistant condition requires the same positive pushing down on the cover as is required for releasing the cover from child-resistant condition. Accordingly, applying the cover for adult use can never inadvertently result in its application into the hard-to-open, child-resistant condition.

THE DRAWING

A typical container representing the best mode presently contemplated of carrying out the invention in practice is illustrated in the accompanying drawing, in which.

Figure 1:
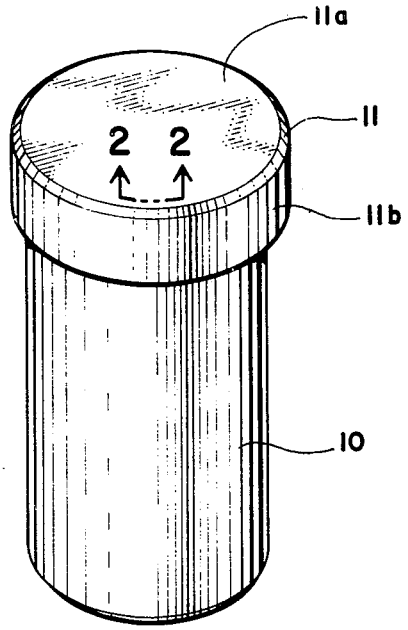
FIG. 1 is a perspective view of a pharmaceutical vial of the invention, with cover latched in the first condition for use by an adult, i.e. the condition in which the vial may be easily opened and closed.
Figure 4:
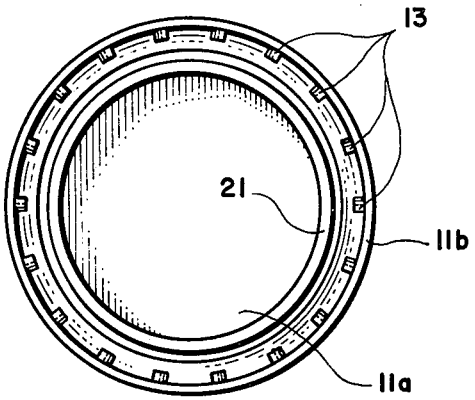
Figure 2:
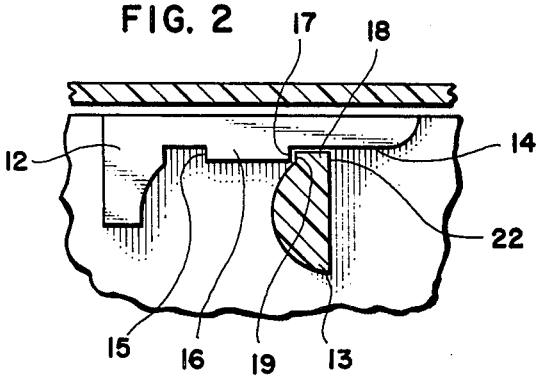
FIG. 2, is a fragmentary, transverse, vertical section taken along the line 2—2 of FIG. 1 and drawn to a larger scale, the view including only a single pair of the locking projections of receptacle part and cover part, respectively.
Figure 3:
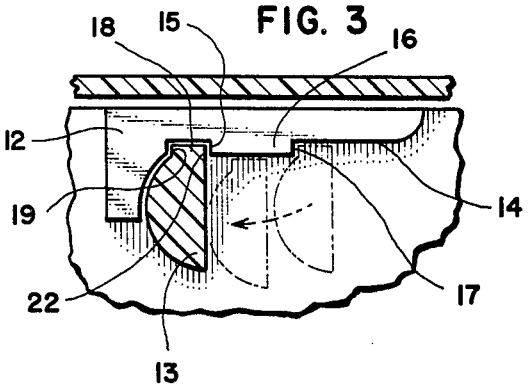

FIG. 3, a view corresponding to that of FIG. 2, but taken after the cover has been moved to the child-resistant latching condition and showing, by dotted lines, progressive positions of the keeper lug relative to the hook formation;

FIG. 4, a bottom plan view of the cover per se; and

Figure 5:
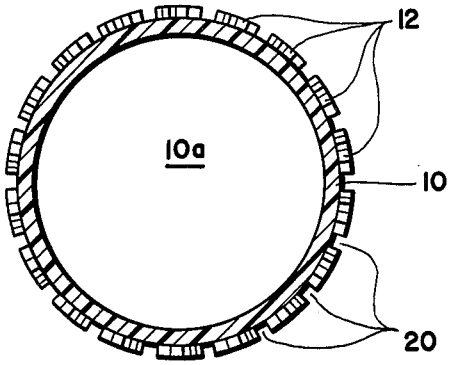

FIG. 5, a view in horizontal section taken through the receptacle part of the container just below and looking up toward the locking projections thereof, so as to show such projections in bottom plan.

DETAILED DESCRIPTION OF THE ILLUSTRATED EMBODIMENT

The pharmaceutical vial and cover of this invention may or may not be of moisture-resistant type, since the invention has to do strictly with the subcombination of dual latching receptacle and cover disclosed and generically claimed in my aforementioned U.S. Pat. No. 3,991,895. However, if not of the moisture-resistant type shown in said patent, spring means of some suitable type, such as the disc insert shown in U.S. Pat. No. 3,072,276, must be supplied to replace the spring action of the skirt that depends interiorly of the vial shown in my patent.

As illustrated, the container is of the moisture-resistant type shown in my patent and comprises a cylindrical vial or receptacle part 10 and a cover part 11 molded to shape from any suitable plastic material, such as from polyethylene and polypropylene, respectively, as is preferable in the instance of a moisture-resistant container, or both parts may be molded from either one or the other of these plastic materials or from some other of the many plastic materials available for use in the fabrication of rigid or semi-rigid containers.

Receptacle 10 has an open mouth **10*a*, FIG. 5, rimmed externally by a series or set, see FIG. 5, of locking or latching projections 12**, each conforming broadly to the designation "hook formation" as used in my said patent.

Cover 11 has a cap portion 11*a* and a rim skirt 11*b* that depends from the cap portion peripherally thereof and overhangs receptacle 10 when in place thereon. Rim skirt 11*b* is provided, internally of the cover, with a corresponding series or set, see FIG. 4, of locking or latching projections 13, each conforming broadly to the designation "keeper lug formation" as used in my said patent.

In accordance with the present invention, each locking or latching projection 12 is provided with a flat and planar retention bed 14 in advance of locking hook 15 and separated from such hook 15 by an elongate stop member 16 that, at one of its ends, defines a positive stop 17 for retention bed 14 and, at the other end, forms locking hook 15. The surface of stop 17 and the surface of hook 15 are preferably planar and disposed substantially normal to the flat and planar surface of the corresponding retention bed 14.

For positive coaction with the positive stops 17 of the set of hook formations 12, the keeper lugs 13 are provided at their tops with respective stop members 18 or rectangular formation, providing positive stops 19 corresponding to the positive stops 17, rather than with smoothly curved tops as in my patent. However, as in my patent, hook formations 12 of the set are spaced apart sufficiently, see 20, FIG. 5, to easily receive the set of keeper lugs 13 therebetween when cover 11 is applied to and over the open mouth 10*a* of vial 10 against the resistance of whatever spring means are provided, here the moisture-sealing skirt 21, FIG. 4, as in my patent.

In use, once cover 11 is applied to and over the open mouth of vial 10, it is turned or twisted clockwise until stops 19 abut solidly against their corresponding stops 17. The rectangular members 18 of keeper lugs 13 are now positioned in their corresponding retention beds 14. This is the first of the dual latching conditions, which provides for easy disengagement of the cover from the vial. Adults are assured of this condition, unless positive action (other than turning or twisting the cover) is taken to move the cover into its second or child-resistant condition. Such positive action requires the exercise of direct downward pushing on the cover against the resistance of the spring means while also exercising a turning action on the cover.

Although combined pressure and twisting by the palm of the hand is common in the art and is mentioned in my said patent as a way of continuing the turning of the cover past the resistance met following traverse by the keeper lugs of the advance retention beds, turning or twisting of the cover to carry the keeper lugs beyond the retention beds and into engagement with the hooks for child-resistance latching is actually so easy in the previous construction shown by my said patent that inadvertent latching into child-resistance condition becomes almost inevitable unless great care is used. The present improvement eliminates any chance of such inadvertent latching.

It should be realized that the keeper lugs need not by partially semi-circular in vertical cross-section as shown, but may be any shape or length that will give adequate strength to the members 18 of rectangular formation, which define the positive stops 17 and which also define similar positive stops 22 that coact with hooks 15 in retaining cover 11 in its child-resistant latched condition.

It is conceivable, though not considered to be nearly as desirable from a plastics molding standpoint, to reverse the placement of the respective locking projections, i.e. to the hook formations on the cover and the keeper lugs on the receptacle.

In any embodiment of the present invention, it should be noted that placing the cover into child-resistant condition requires the same exercise of force as does its removal from child-resistant condition. Accordingly, any person who, by reason of age or weakened physical condition, cannot open the container from child-resistant condition, likewise cannot inadvertently place it in child-resistant condition, yet is provided with a container that is easily closeable and that will remain closed to satisfactorily protect the contents thereof.

Whereas there is here illustrated and specifically described a container presently contemplated as the best mode of carrying out the invention in practice, it should be understood that changes may be made without departing from the broader teachings hereof and from the permissible scope of the claims that follow.

I claim:

1. In a child-resistant container of the dual-latching type that comprises a receptacle having an open mounth and a cover therefor, sets of locking projections rimming the cover and said open mouth of the receptacle, respectively, and spring means for normally urging cover and receptacle apart, the projections of one of said sets being of hook formation and the projections of the other of said sets being of keeper lug formation for engaging and latching with said projections of hook formation, and the said projections of hook formation each having an easily disengaged retention bed in advance of the hook thereof, which can be selectively engaged by a keeper lug during closing of the receptacle, the improvement wherein each projection of hook formation has an elongate, positive stop member extending between said bed and said hook, and each keeper lug has a corresponding and coacting, positive stop member at its top, the bed end of the stop member of the hook formation defining a positive stop for said keeper lug to prevent inadvertent turning of the cover beyond a first, easily disengaged latching condition into a second, child-resistant condition, and the hook end thereof defining the hook as a positive stop for said keeper lug to prevent release of the cover by mere turning thereof, there being required a combination of positive downward pressure on, followed by turning of, the cover for both placing the cover into and releasing the cover from child-resistant condition.

2. The invention of claim 1, wherein the retention bed of each hook formation has a flat, planar bed surface, and the top surface of each keeper lug stop member is correspondingly flat and planar.

3. The invention of claim 2, wherein the stop surfaces of each hook formation stop member and the stop surfaces of each keeper lug stop member are substantially normal to the corresponding retention bed and to the top surface of the corresponding keeper lug stop member.

* * * * *